US007174683B2

(12) United States Patent
Jaycox et al.

(10) Patent No.: US 7,174,683 B2
(45) Date of Patent: Feb. 13, 2007

(54) IMPACT-RESISTANT SHUTTER ASSEMBLY

(75) Inventors: Jeffrey S. Jaycox, Florence, SC (US); David Cottingham, Dillon, SC (US)

(73) Assignee: Tapco International, Wixom, MI (US)

( * ) Notice: Subject to any disclaimer, the term of this patent is extended or adjusted under 35 U.S.C. 154(b) by 478 days.

(21) Appl. No.: 10/264,476

(22) Filed: Oct. 4, 2002

(65) Prior Publication Data

US 2004/0010988 A1 Jan. 22, 2004

Related U.S. Application Data

(60) Provisional application No. 60/397,515, filed on Jul. 19, 2002, provisional application No. 60/404,459, filed on Aug. 19, 2002.

(51) Int. Cl.
*E06B 3/26* (2006.01)

(52) U.S. Cl. ..... 52/202; 52/203; 52/473; 52/784.1; 428/229.1; 428/346; 428/518; 49/74.1

(58) Field of Classification Search ..... 52/784.1, 52/202–203, 455–456, 473–474, 314, 800.1; 428/109, 113, 299.7, 346, 518, 520, 522, 428/911; 89/36.02; 49/74.1
See application file for complete search history.

(56) References Cited

U.S. PATENT DOCUMENTS 4,791,765 A * 12/1988 Noggle ..... 52/309.2
5,540,018 A 7/1996 Biggers
5,540,026 A * 7/1996 Gartland ..... 52/455
5,848,505 A * 12/1998 Taylor ..... 52/202
5,885,685 A * 3/1999 Tingley ..... 428/105
6,004,648 A * 12/1999 Snyder ..... 428/106
6,089,300 A 7/2000 Woodside et al.
6,125,905 A 10/2000 Woodside et al.
6,131,354 A 10/2000 Thompson
6,296,039 B1 10/2001 Mullet et al.
6,341,639 B1 1/2002 Mullet et al.
6,393,777 B1 5/2002 Renfrow
6,408,592 B1 7/2002 Hourani
6,562,435 B1 * 5/2003 Brillhart, III et al. ..... 428/105
2003/0115817 A1 * 6/2003 Blackwell et al. ..... 52/456

* cited by examiner

*Primary Examiner*—Winnie Yip
(74) *Attorney, Agent, or Firm*—Howard & Howard Attorneys, P.C.

(57) ABSTRACT

An impact-resistant shutter does not fracture upon impact from debris. The shutter includes a decorative panel and a support panel. The decorative panel has an outer surface and an inner surface and includes a first chemical composition. The support panel has a first surface and a second surface and includes a fiber composition. The fiber composition is incompatible with the first chemical composition. A second chemical composition is integrated into the support panel at the first surface. The second chemical composition is compatible with the first chemical composition. Due to this second chemical composition present at the first surface, the fiber composition in the support panel can be bonded to the inner surface of the decorative panel. The fiber composition provides impact resistance to the decorative panel to prevent fracturing of the decorative panel upon impact from debris.

39 Claims, 6 Drawing Sheets

IMPACT-RESISTANT SHUTTER ASSEMBLY

RELATED APPLICATIONS

This patent application claims priority to and all advantages of U.S. Provisional Patent Application Nos. 60/397,515 and 60/404,459, which were filed on Jul. 19, 2002 and Aug. 19, 2002, respectively.

FIELD OF THE INVENTION

The subject invention generally relates to a shutter assembly. More specifically, the subject invention relates to an impact-resistant shutter assembly that does not fracture upon impact from debris.

BACKGROUND OF THE INVENTION

As is known in the art, shutters are used for both aesthetic and functional purposes on a dwelling, such as a residential or commercial building. Aesthetically, shutters are utilized to add décor and character to the dwelling. Although these decorative types of shutters typically remain in an open position on the dwelling, they create an appearance of being a functional shutter.

On the other hand, in a closed position, the shutters are used for functional purposes. These functional shutters typically include a decorative panel and a support panel backing, or supporting, the decorative panel. These functional shutters pivot from the open position to the closed position and operate to protect windows, doors, and other openings of the dwelling during inclement weather, such as precipitation storms, wind storms, and hurricanes.

However, the shutters of the prior art are deficient. More specifically, because the decorative shutters are not intended for functional purposes, they are manufactured from raw materials that do not provide adequate protection to dwellings. The functional shutters of the prior art, even in the closed position, are deficient in that they do not satisfy ASTM Standard Specifications for "Storm Shutters" as required according to the International Building Code (IBC). These shutters are not impact-resistant. Instead, these shutters fracture upon impact from debris, such as windborne debris that is particularly active during the inclement weather. Ultimately, the conventional shutters do not adequately protect the windows, doors, and other openings of the dwelling during the inclement weather.

Some shutters have attempted to incorporate certain compositions into the decorative panel and the support panel to bolster the impact resistance provided by the shutter. However, these attempts have not compatibilized the compositions between the decorative panel and the support panel. As a result, the support panel may not be adequately bonded to the decorative panel such that the support panel does not adequately back, or support, the decorative panel, and the decorative panel frequently fractures independent of the support panel.

Due to the deficiencies in the shutters of the prior art, including those described above, it is desirable to provide a novel shutter assembly that satisfies the ASTM Standard Specifications as required by the IBC such that the shutter assembly is impact-resistant and does not fracture upon impact from debris.

SUMMARY OF THE INVENTION AND ADVANTAGES

An impact-resistant shutter assembly is disclosed. In one embodiment of the subject invention, the shutter assembly includes a decorative panel having an outer surface and an inner surface and a support panel having a first surface and a second surface. The decorative panel comprises a first chemical composition and the support panel comprises a fiber composition that is incompatible with the first chemical composition.

A second chemical composition is integrated into the support panel at the first surface. The second chemical composition is compatible with the first chemical composition of the decorative panel. As such, the fiber composition in the support panel can be bonded to the inner surface of the decorative panel. The fiber composition in the support panel provides impact resistance to the decorative panel to prevent fracturing of the decorative panel upon impact from debris.

In a further embodiment of the subject invention, the fiber composition in the support panel comprises at least one of polypropylene fibers, polyester fibers, and aromatic polyamide fibers. These fibers provide the impact resistance to the decorative panel to prevent any fracturing.

In yet a further embodiment of the subject invention, the decorative panel comprises polyvinyl chloride. The fiber composition in the support panel is incompatible with the polyvinyl chloride. In this particular embodiment, polyvinyl chloride is integrated into the support panel at the first surface, and a solvent cement is disposed between the first surface of the support panel and the inner surface of the decorative panel. The solvent cement bonds the fiber composition to the inner surface of the decorative panel through interaction with the polyvinyl chloride of the support panel.

Accordingly, the subject invention provides a shutter assembly that is impact-resistant and does not fracture upon impact from debris. It is also advantageous that, in the shutter assembly of the subject invention, the compositions of the support panel and the decorative panel are compatible such that the support panel can adequately bond to the decorative panel to prevent fracturing of the decorative panel upon impact from debris.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
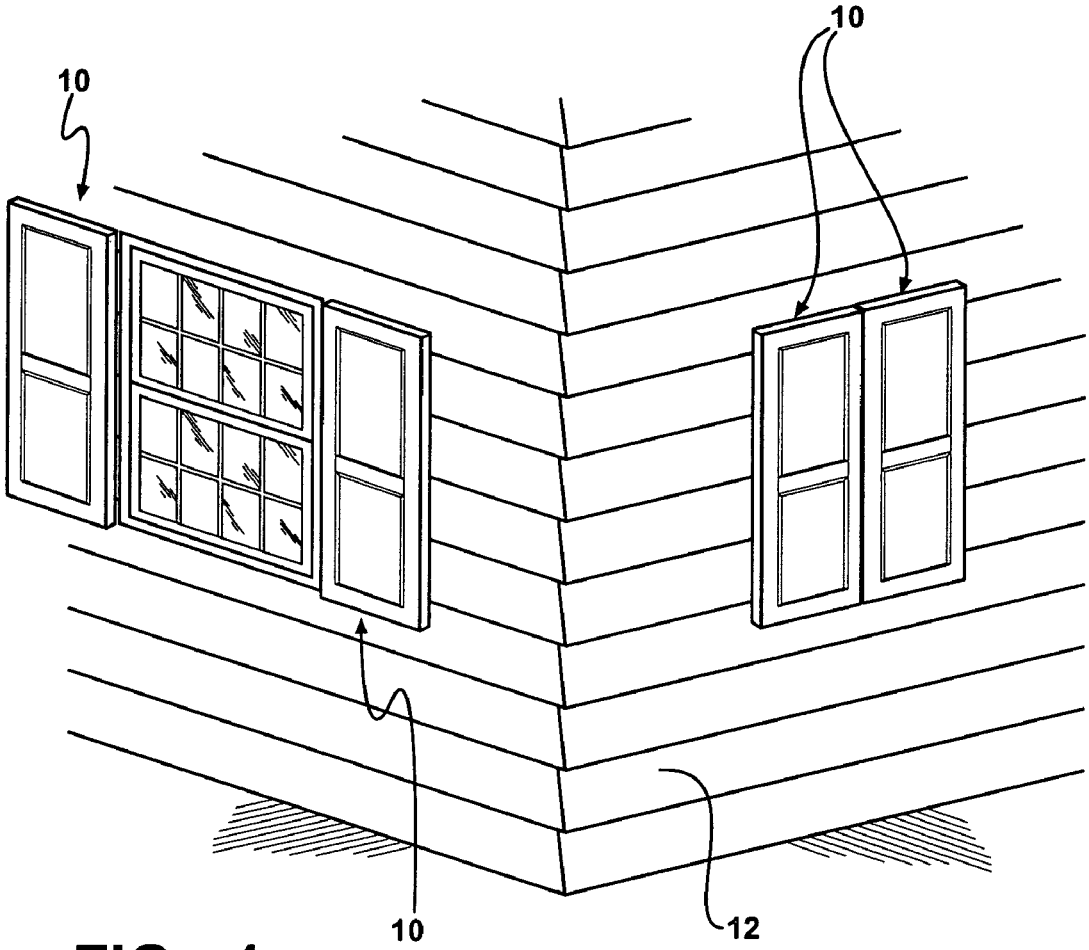
FIG. 1 is a perspective view of a dwelling having one impact-resistant shutter assembly in an open position and one impact-resistant shutter assembly in a closed position.
Figure 2A:
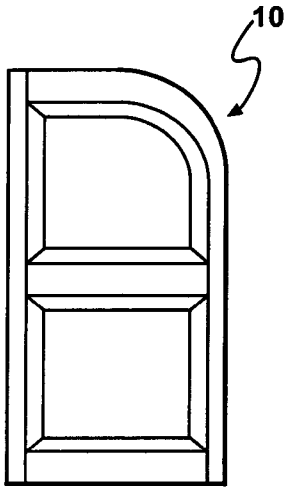
FIG. 2A–2E are front views illustrating various configurations of a raised panel shutter assembly according to the subject invention.
Figure 2B:
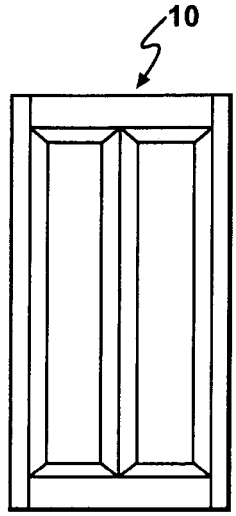
Figure 2C:
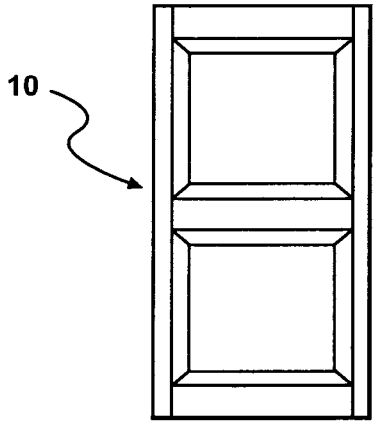
Figure 2D:
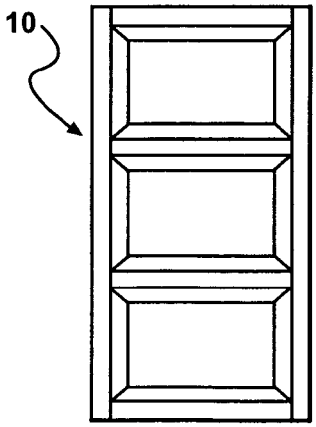
Figure 2E:
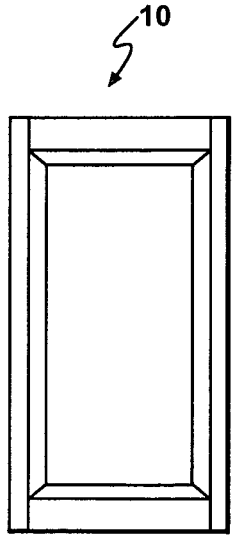
Figure 3A:
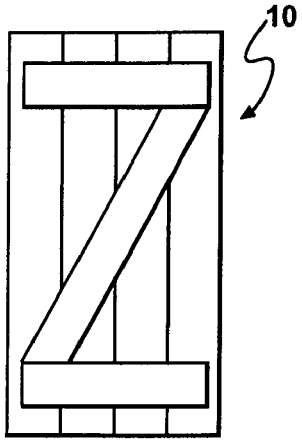
FIG. 3A–3E are front views illustrating various configurations of a board-and-batten shutter assembly according to the subject invention.
Figure 3B:
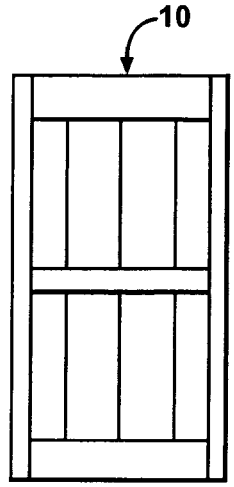
Figure 3C:
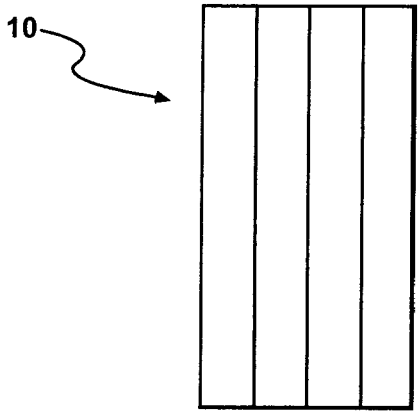
Figure 3D:
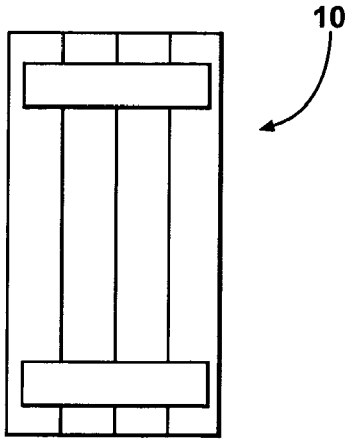
Figure 3E:
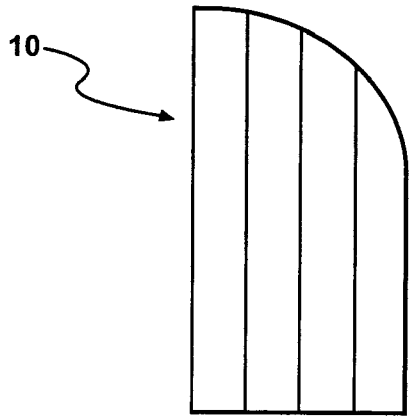
Figure 4A:
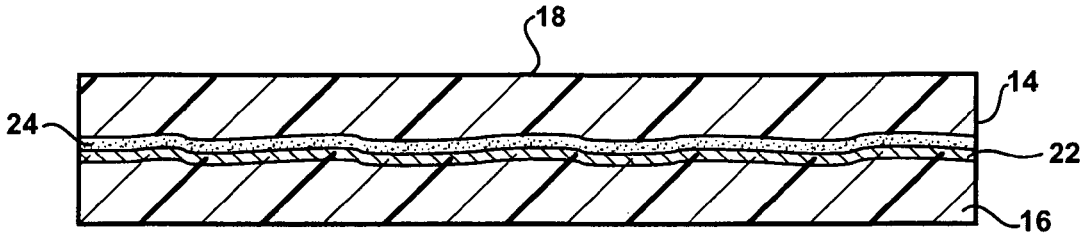
FIG. 4A is a cross-sectional side view of the shutter assembly illustrating a decorative panel, solvent cement, and a support panel including a second chemical composition.
Figure 4B:
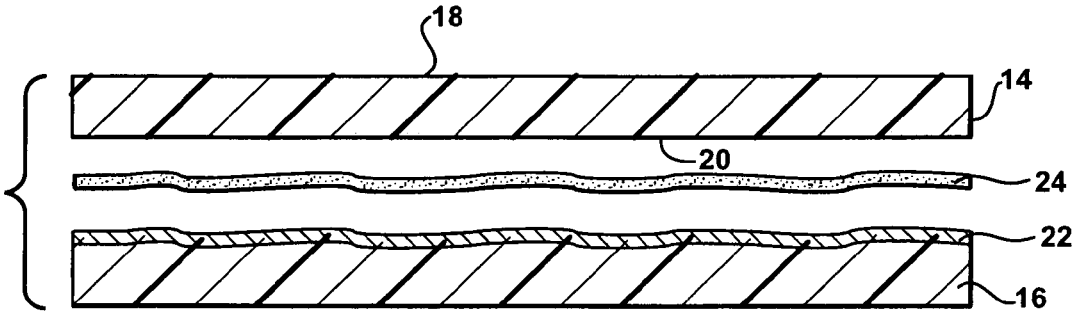
FIG. 4B is an exploded cross-sectional side view of the shutter assembly of FIG. 4A.

Referring to the Figures, wherein like numerals indicate like or corresponding parts throughout the several views, an impact-resistant shutter assembly is generally disclosed at 10. The shutter assembly 10 is used for both aesthetic and functional purposes on a dwelling 12, such as a residential building (as disclosed in FIG. 1) or a commercial building. The shutter assembly 10 is mounted to the dwelling 12 via a plurality of fasteners, such as hinges and screws and the like. These fasteners are not disclosed in the Figures as they are not pertinent to the subject invention. The shutter assembly 10 of the subject invention is used functionally to pivot from an open position to a closed position to protect windows, doors, and other openings of the dwelling 12 during inclement weather, such as precipitation storms, wind storms, and hurricanes. In FIG. 1, one shutter assembly 10 is disclosed in an open position, and the other shutter assembly 10 is disclosed in the closed position. The shutter assemblies 10 are pivotable between the open position and the closed position. The shutter assembly 10 functions to protect the dwelling 12 by absorbing impact from debris, such as windborne debris that is particularly active during inclement weather.

It is to be understood that one shutter assembly 10 according to the subject invention is a single shutter. That is, one shutter assembly 10 is one left side shutter or one right side shutter such that two shutter assemblies 10 are preferred to adequately "protect the dwelling 12. Referring particularly to FIGS. 2A–2E, the shutter assembly 10 is disclosed as a shutter assembly 10 that is commonly referred to as a raised panel shutter assembly 10. FIGS. 2A–2E illustrate various configurations, or styles, of the raised panel shutter assembly 10. On the other hand, referring particularly to FIGS. 3A–3E, the shutter assembly 10 is disclosed as a shutter assembly 10 that is commonly referred to as a board-and-batten shutter assembly 10. FIGS. 3A–3E illustrate various configurations, or styles, of the board-and-batten shutter assembly 10.

The shutter assembly 10 includes a decorative panel 14 and a support panel 16. For the descriptive purposes of the subject invention, use of the terminology panel is synonymous with the terminology layer. The decorative panel 14 has an outer surface 18 and an inner surface 20. Although not required, it is preferred that the decorative panel 14 has a thickness ranging from 12 to 19, preferably from 13 to 16, mm. Also, the decorative panel 14 includes a first chemical composition. In preferred embodiments of the subject invention, the first chemical composition is further defined as a first thermoplastic resin composition, including polyvinyl chloride (PVC). As understood by those skilled in the art, a thermoplastic resin composition is capable of softening when heated and hardening, or re-setting, again when cooled. One suitable decorative panel 14 is commercially available as Komatex® from Kommerling of Huntsville, Ala. It is to be understood that, instead of PVC, the first chemical composition may include chemical and functional equivalents of PVC including, but not limited to, polyvinyl acetate (PVAc).

The support panel 16 has a first surface and a second surface. For clarification in the Figures, the first and second surfaces of the support panel are disclosed but not numbered. Although not required, it is preferred that the support panel 16 has a thickness of approximately 0.080 inches, or from 1.5 to 3 mm. Ultimately, the first surface of the support panel 16 is bonded to the inner surface 20 of the decorative panel 14. This bond is described additionally below. The support panel 16 includes a fiber composition that is different from, and incompatible with, the first chemical composition of the decorative panel 14. The fiber composition of the support panel 16 is incompatible with the first chemical composition in that the fiber composition cannot be directly bonded to the first chemical composition. The fiber composition comprises at least one of polypropylene fibers, polyester fibers, and aromatic polyamide fibers. These fibers cannot be directly bonded to the first chemical composition, e.g. to the PVC, of the decorative panel 14.

It is also preferred that the fiber composition of the support panel 16 further include glass fibers, i.e., fiber glass. If included, the glass fibers are preferably continuous filament glass fibers to maximize the impact resistance provided by the fiber composition to the decorative panel 14. However, although it is not preferred, the glass fibers included in the fiber composition may include common chopped fibers, and the like.

In one embodiment of the subject invention, the fiber composition of the support panel 16 includes the polypropylene fibers and the glass fibers. In another embodiment of the subject invention, the fiber composition of the support panel 16 includes the polyester fibers and the glass fibers. In a further embodiment of the subject invention, the fiber composition of the support panel 16 includes a blend of the polypropylene fibers and the polyester fibers and the glass fibers. In yet a further embodiment of the subject invention, the fiber composition of the support panel 16 includes the aromatic polyamide fibers. If included in the fiber composition, the aromatic polyamide fibers are formed from polyparaphenylene terephthalamide, which is a nylon-like polymer commercially available as Kevlar® from DuPont of Wilmington, Del. Of course, aromatic polyamide fibers other than Kevlar® are suitable for use in the fiber composition of the subject invention.

One suitable support panel 16 is commercially available as Bulitex® from U.S. Liner Company, a division of American Made, LLC, of Ambridge, Pa. Bulitex® is a thermoplastic composite having a fiber composition that includes continuous, woven fiberglass. In addition to the continuous, woven fiberglass, the fiber composition of Bulitex® also includes the polypropylene fibers, the polyester fibers, or combinations thereof. Alternatively, Kevlar® panels may also be utilized as the support panel 16.

The shutter assembly 10 of the subject invention further includes a second chemical composition 22. The second chemical composition 22 is integrated into the support panel 16 at the first surface of the support panel 16. The second chemical composition 22 is compatible with the first chemical composition of the decorative panel 14. As such, the fiber composition of the support panel 16 can be bonded to the inner surface 20 of the decorative panel 14. The fiber composition bonds to the inner surface 20 of the decorative panel 14 as described below. In this position, where the support panel 16 is bonded to the decorative panel 14, the fiber composition in the support panel 16 provides impact resistance to the decorative panel 14 thereby preventing fracturing of the decorative panel 14 upon impact from debris.

In preferred embodiments of the subject invention, the second chemical composition 22, which is integrated into the support panel 16 at the first surface of the support panel 16, is further defined as a second thermoplastic resin composition, including PVC. As with the first chemical composition, it is to be understood that, instead of PVC, the second chemical composition 22 may include chemical and functional equivalents of PVC including, but not limited to, polyvinyl acetate (PVAc). Furthermore, although it is not required, it is most preferred that the first chemical composition and the second chemical composition 22 are identical to optimize the compatibility between the decorative panel 14 and the support panel 16.

Although the fiber composition of the support panel 16 is incompatible with the first chemical composition, the fiber composition is not incompatible with the second chemical composition 22 because the second chemical composition 22 is actually integrated into the support panel 16 at the first surface during manufacturing of the support panel 16 with the fiber composition. During the manufacturing, the second chemical composition 22 is embedded into the support panel 16. Once embedded, the second chemical composition 22 is coated on the support panel 16 at the first surface and at the second surface as described below.

The shutter assembly 10 further comprises a solvent cement 24. Solvent cements 24 are sometimes generically referred to in the art as PVC cements. The solvent cement 24 is disposed between the support panel 16 and the decorative panel 14 for bonding the fiber composition to the inner surface 20 of the decorative panel 14. The solvent cement 24 bonds the fiber composition to the inner surface 20 of the decorative panel 14 through interaction with the second chemical composition 22. More specifically, the solvent cement 24 actually melt bonds the first surface of the support panel 16 to the inner surface 20 of the decorative panel 14. The solvent cement 24 softens the second chemical composition 22 at the first surface of the support panel 16 and softens the first chemical composition at the inner surface 20 of the decorative panel 14 such that the support panel 16 and the decorative panel 14 fuse together. Melt bonding is known in the art as a chemical, as opposed to a mechanical, bond.

In certain embodiments of the subject invention, the solvent cement 24 generally includes at least one of methyl ethyl ketone (MEK), tetrahydrofuran (THF), acetone, and cyclohexanone. Preferably, the solvent cement 24 includes a blend of MEK, THF, and cyclohexanone. The solvent cement 24 may further include PVC. If included in the solvent cement 24, the PVC operates as a carrier resin for the MEK, THF, acetone, and/or cyclohexanone. One solvent cement 24 suitable for use in the subject invention is commercially available as Christy's Red Hot Blue Glue or Red Hot Clear Glue from T. Christy Enterprises, Inc. of Anaheim, Calif.

In the embodiment where the fiber composition of the support panel 16 includes the polypropylene fibers, the solvent cement 24 bonds the polypropylene fibers to the inner surface 20 of the decorative panel 14 through interaction with the second chemical composition 22, which is most preferably PVC. The polypropylene fibers provide the impact resistance to the decorative panel 14 to prevent fracturing of the decorative panel 14.

In the embodiment where the fiber composition of the support panel 16 includes the polyester fibers, the solvent cement 24 bonds the polyester fibers to the inner surface 20 of the decorative panel 14 through interaction with the second chemical composition 22, which is most preferably PVC. The polyester fibers provide the impact resistance to the decorative panel 14 to prevent fracturing of the decorative panel 14.

In the embodiment where the fiber composition of the support panel 16 includes the blend of the polypropylene fibers and the polyester fibers, the solvent cement 24 bonds the polypropylene and the polyester fibers to the inner surface 20 of the decorative panel 14 through interaction with the second chemical composition 22, which is most preferably PVC. The polypropylene and polyester fibers provide the impact resistance to the decorative panel 14 to prevent the fracturing of the decorative panel 14.

In the embodiment where the fiber composition of the support panel 16 includes the aromatic polyamide fibers, the solvent cement 24 bonds the aromatic polyamide fibers to the inner surface 20 of the decorative panel 14 through interaction with the second chemical composition 22, which is most preferably PVC. The aromatic polyamide fibers provide the impact resistance to the decorative panel 14 to prevent the fracturing of the decorative panel 14.

Ultimately, in preferred embodiments of the subject invention, no matter what the make up of the fiber composition is, the solvent cement 24 bonds the first surface of the support panel 16 to the inner surface 20 of the decorative panel 14 through interaction with PVC in the decorative panel 14 and the support panel 16.

Figure 5A:
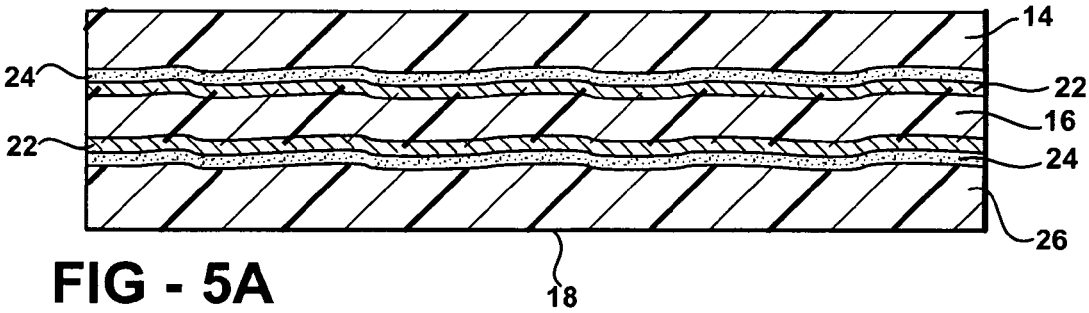
FIG. 5A is a cross-sectional side view of the shutter assembly illustrating the decorative panel, solvent cement, the support panel including the second chemical composition integrated at first and second surfaces of the support panel, and a second decorative panel.
Figure 5B:
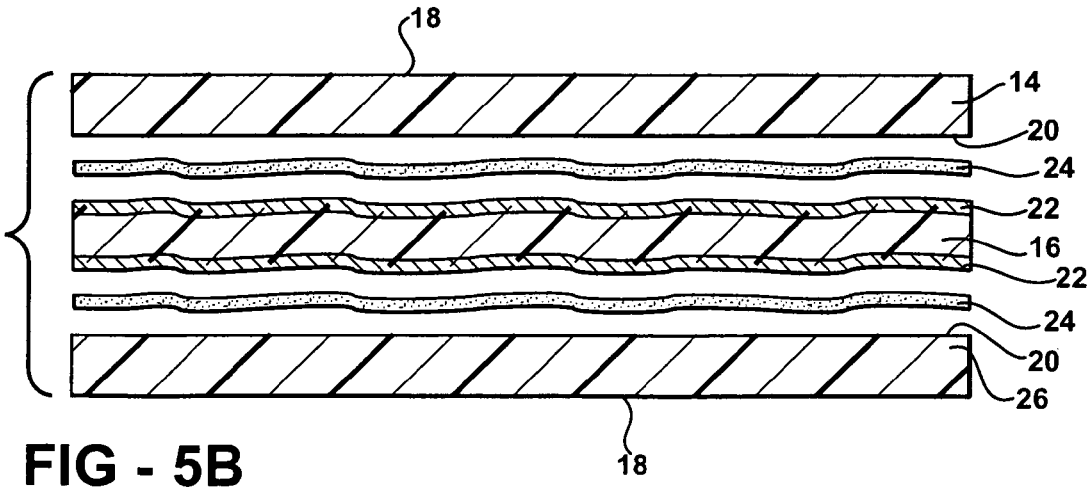
FIG. 5B is an exploded cross-sectional side view of the shutter assembly of FIG. 5B.

Referring primarily to FIGS. 5A and 5B, the shutter assembly 10 of the subject invention further includes a second decorative panel 26 having an outer surface 18 and an inner surface 20. Ultimately, the second surface of the support panel 16 is bonded to the inner surface 20 of the second decorative panel 26 such that the fiber composition in the support panel 16 can provide impact resistance to the second decorative panel 26 to prevent fracturing of the second decorative panel 26 upon impact from debris. The support panel 16 is essentially laminated between the decorative panel 14 and the second decorative panel 26. Also, like the decorative panel 14, the second decorative panel 26 includes the first chemical composition. As such, the description set forth above pertaining to the first chemical composition in the decorative panel 14 is also applicable here relative to the second decorative panel 26.

The second chemical composition 22, most preferably PVC, is also integrated into the support panel 16 at the second surface. As a result, the fiber composition of the support panel 16 can be bonded to the inner surface 20 of the second decorative panel 26. The fiber composition, therefore, also provides impact resistance to the second decorative panel 26 to prevent fracturing of the second decorative panel 26 upon impact from debris.

If the second decorative panel 26 is included in the shutter assembly 10, then the solvent cement 24 is also disposed between the support panel 16 and the second decorative panel 26 for bonding the fiber composition to the inner surface 20 of the second decorative panel 26. The solvent cement 24 bonds the fiber composition to the second decorative panel 26 through interaction with the second chemical composition 22. More specifically, in preferred embodiments of the subject invention where the first chemical composition and the second chemical composition 22 are PVC, the solvent cement 24 bonds the first surface of the support panel 16 to the inner surface 20 of the decorative panel 14 through interaction with the polyvinyl chloride in the decorative panel 14 and the support panel 16. Similarly, the solvent cement 24 bonds the second surface of the support panel 16 to the inner surface 20 of the second decorative panel 26 through interaction with the polyvinyl chloride in the second decorative panel 26 and the support panel 16.

Figure 6:
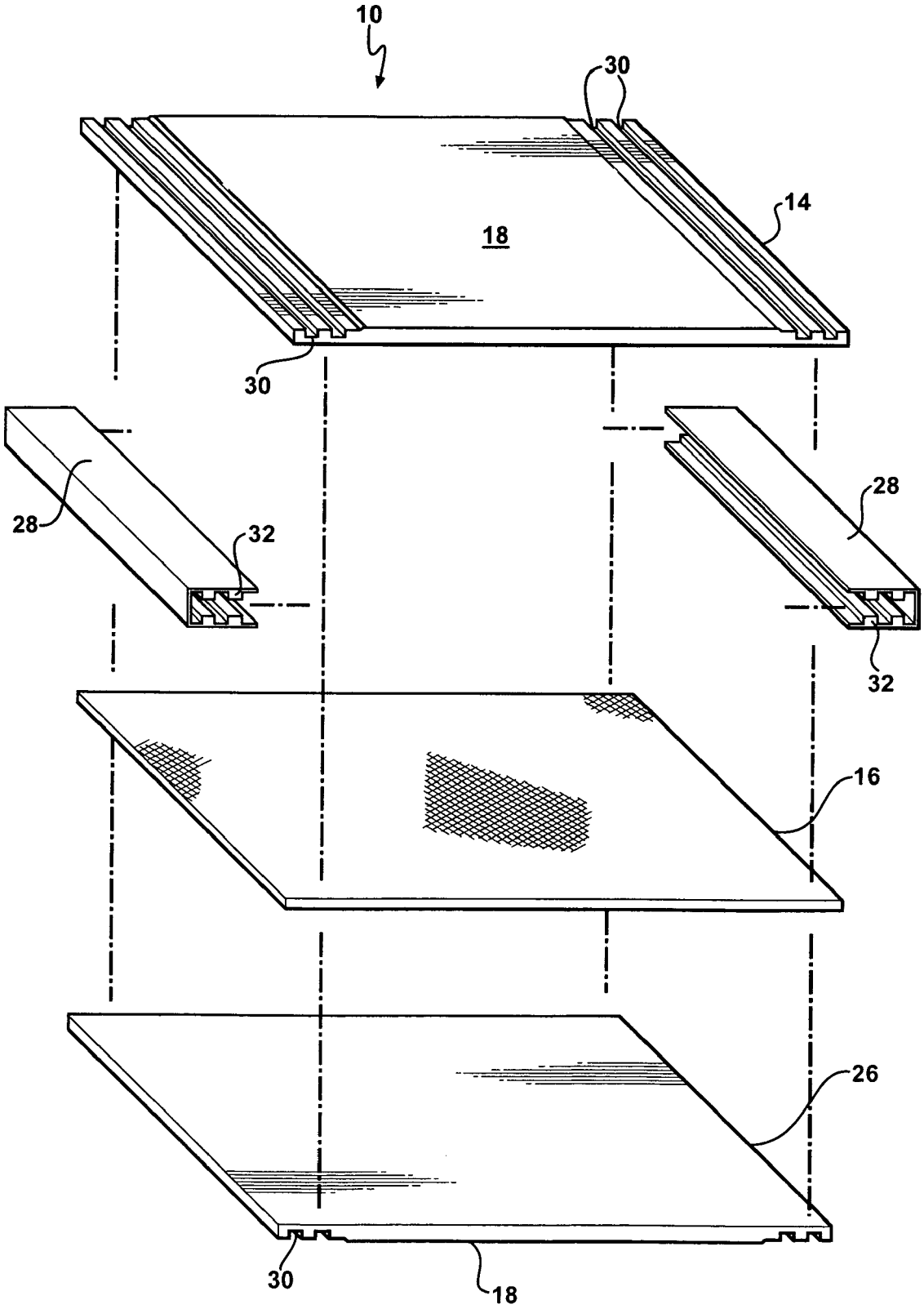
FIG. 6 is an exploded perspective view of a raised panel shutter assembly according to the subject invention illustrating stiles that are coupled to outer surfaces of the decorative panel and the second decorative panel.

Referring to FIG. 6, the shutter assembly 10 may further include at least one stile 28 coupled to the outer surface 18 of the decorative panel 14. The stile 28 is primarily utilized with the raised panel shutter assemblies 10 disclosed in FIGS. 2A–2E. The stile 28 is a separate, add-on component to the shutter assembly 10. The stile 28 provides additional strength to the shutter assembly 10 and also a location to mount fasteners, not disclosed in the FIGS. (e.g. hinges or latches), to the shutter assembly 10. As disclosed in FIG. 6, it is preferred that the shutter assembly 10 includes two stiles 28. It is also preferred that the stile 28 is coupled to the outer surfaces 18 of both the decorative panel 14 and the second decorative panel 26. To receive the stile 28, the outer surfaces 18 of both the decorative panel 14 and the second decorative panel 26 include at least one groove 30. Furthermore, the stile 28 includes at least one flange 32, or detent, that is disposed in the groove 30 for coupling the stile 28 to the decorative panel 14. As disclosed in FIG. 6, it is preferred that the outer surfaces 18 of both the decorative panel 14 and the second decorative panel 26 include a plurality of grooves 30. As a result, it is preferred that the stile 28 include a plurality of flanges 32, or detents, that mate with the grooves 30 in the outer surfaces 18. The flanges 32, i.e., detents, and the grooves 30 are complimentary to each other.

It is preferred that the stile 28 is made from fiberglass. It is also preferred that the stile 28 is bonded to the outer surface 18 of the decorative panel 14 with an adhesive. Preferably, the adhesive is a methacrylate-based adhesive. One suitable methacrylate-based adhesive for use in the present invention is commercially available as Plexus AO420 from ITW Plexus, a division of Illinois Tool Works. Other suitable methacrylate-based adhesives are commercially available from Loctite Corporation, a division of Henkel Corporation.

Figure 7:
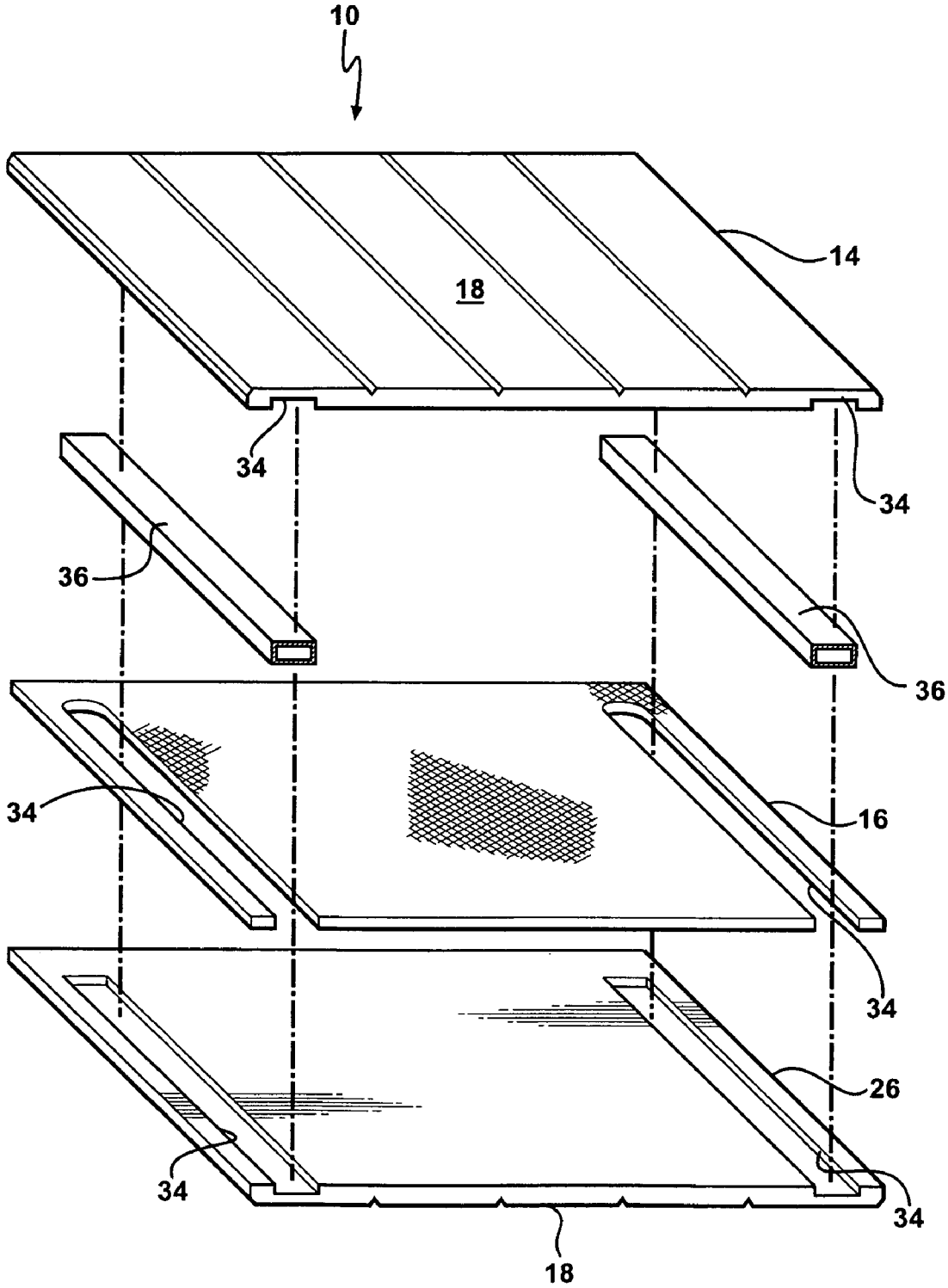
FIG. 7 is an exploded perspective view of a board-and-batten shutter assembly according to the subject invention illustrating a channel and a strengthening element disposed within the channel.

Referring to FIG. 7, at least one of the decorative panel 14 and the support panel 16 include a channel 34, or strip. The channel 34 is machined into at least one of the decorative panel 14 and the support panel 16. Preferably, the channel 34 is formed from a plurality of channels 34 machined into the decorative panel 14, the support panel 16, and the second decorative panel 26. It is also preferred that there are two channels 34 in the shutter assembly 10, one at each side of the shutter assembly 10.

The channel 34 receives a strengthening element 36. In this position, the strengthening element 36 is encapsulated or sandwiched between the decorative panel 14, 26. The channel 34 and the strengthening element 36 are primarily utilized with the board-and-batten shutter assemblies 10 disclosed in FIGS. 3A–3E. In the preferred embodiment, one strengthening element 36 is disposed in the channel 34 formed at each side of the shutter assembly 10. The strengthening element 36 is disposed within the channel 34 for providing supplemental strength to the shutter assembly 10 and for providing a location to mount the fasteners (e.g. hinges or latches) to the shutter assembly 10. In one embodiment of the subject invention, the strengthening element 36 is an aluminum tube, preferably a squared aluminum tube. If so, it is preferred that 6063-T6 aluminum is utilized.

The shutter assembly 10 of the subject invention is impact-resistant, or storm-rated, because the shutter assembly 10 satisfies the pass/fail criteria outlined in:

1. ASTM Standard Specification "PERFORMANCE OF EXTERIOR WINDOWS, CURTAIN WALLS, DOORS AND STORM SHUTTERS IMPACTED BY WIND-BORNE DEBRIS IN HURRICANES" (Designation E 1996-02);
2. ASTM Standard Test Method "PERFORMANCE OF EXTERIOR WINDOWS, CURTAIN WALLS, DOORS, AND STORNM SHUTTERS IMPACTED BY MISSILE(S) AND EXPOSED TO CYCLIC PRESSURE DIFFERENTIALS" (Designation E 1886-97); and
3. ASTM Standard Test Method "STRUCTURAL PERFORMANCE OF EXTERIOR WINDOWS, CURTAINS WALLS, AND DOORS BY UNIFORM STATIC AIR PRESSURE DIFFERENCE" (Designation E 330-97$^{\epsilon 1}$).

The disclosures of the ASTM Standard Specification and Test Methods listed above are herein incorporated by reference in their entirety.

More specifically, the raised panel shutter assemblies 10 of the subject invention are approved according to these ASTM Specification and Test Methods to a maximum design span of 84 inches and a maximum design pressure of 60.0 PSF (pounds per square foot), and the board-and-batten shutter assemblies 10 of the subject invention are approved according to these ASTM Specification and Test Methods a maximum design span of 84 inches and a maximum design pressure of 60.0 PSF. Furthermore, both the raised panel shutter assemblies 10 and the board-and-batten shutter assemblies 10 were tested to a Level 'D' in the Large Missile Impact Test (see Designation E 1996-02).

The process to manufacture the raised panel shutter assembly 10 includes several steps. A machine operator, using a CNC machine, cuts the decorative panel 14 and the second decorative panel 26 to the correct size. The machine operator then cuts the support panel 16 to size. The support panel 16 is then laminated between the decorative panel 14 and the second decorative panel 26 using the solvent cement 24. The stiles 28 are then cut to length. An interior of the stiles 28 is then filled with the adhesive, and the stiles 28 are bonded to the outers surfaces 18 of the decorative panels 14, 26 such that the flanges 32 are disposed within their respective grooves 30. The entire raised panel shutter assembly 10 is then clamped to allow the adhesive to set.

The process to manufacture the board-and-batten shutter assembly 10 includes several steps. The machine operator, using the CNC machine, cuts the decorative panel 14 and the second decorative panel 26 to the correct size. The machine operator then cuts the support panel 16 to size. The support panel 16 is then laminated to one of the decorative panel 14 and the second decorative panel 26 using the solvent cement 24. The partially assembled board-and-batten shutter assembly 10 is then re-cut to cut the channel 34 for the strengthening element 36. The strengthening element 36 is then cut to length and disposed in the channel 34 preferably using the solvent cement 24 or some other suitable adhesive. The entire board-and-batten shutter assembly 10 is then stapled together using a suitable shutter fastener, such as stainless steel brads. Once the solvent cement 24 sets, the shutter fastener may be removed. Alternatively, the board-and-batten shutter assembly 10 may be clamped until the solvent cement 24 sets.

It is most preferred that the shutter assembly 10 of the subject invention is utilized on the dwelling 12 in combination with a locking assembly that locks the shutter assembly 10 by retaining the shutter assembly 10 in the closed position during inclement weather. Such locking assemblies are commonly referred to as a storm bar. One such locking assembly is disclosed in commonly assigned U.S. patent application Ser. No. 10/264,477, entitled "Locking Assembly For Shutters" which was filed on the same day as this application, the disclosure of which is herein incorporated by reference in its entirety. However, the shutter assembly 10 of the subject invention may be used without or with any type of locking assembly.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that reference numerals are utilized merely for convenience and are not to be limiting in any way, and that the invention may be practiced otherwise than as specifically described.

What is claimed is:

1. An impact-resistant shutter assembly comprising:

a decorative panel having an outer surface and an inner surface and comprising a first thermoplastic resin composition;

a support panel having a first surface and a second surface and comprising a fiber composition that is incompatible with said first thermoplastic resin composition of said decorative panel; and a second thermoplastic resin composition integrated into said support panel at said first surface and being compatible with said first thermoplastic resin composition of said decorative panel such that said fiber composition can be bonded to said inner surface of said decorative panel, wherein said fiber composition in said support panel provides impact resistance to said decorative panel to prevent fracturing of said decorative panel upon impact from debris.

2. A shutter assembly as set forth in claim 1 further comprising a solvent cement disposed between said support panel and said decorative panel for bonding said fiber composition to said inner surface of said decorative panel through interaction with said second thermoplastic resin composition.

3. A shutter assembly as set forth in claim 2 wherein said solvent cement comprises at least one of methyl ethyl ketone, tetrahydrofuran, acetone, and cyclohexanone.

4. A shutter assembly as set forth in claim 1 wherein said fiber composition comprises at least one of polypropylene fibers, polyester fibers, and aromatic polyamide fibers.

5. A shutter assembly as set forth in claim 4 wherein said fiber composition further comprises glass fibers.

6. A shutter assembly as set forth in claim 1 wherein said fiber composition comprises polypropylene fibers.

7. A shutter assembly as set forth in claim 6 further comprising a solvent cement disposed between said support panel and said decorative panel for bonding said polypropylene fibers to said inner surface of said decorative panel through interaction with said second thermoplastic resin composition.

8. A shutter assembly as set forth in claim 7 wherein said solvent cement comprises at least one of methyl ethyl ketone, tetrahydrofuran, acetone, and cyclohexanone.

9. A shutter assembly as set forth in claim 6 wherein said fiber composition further comprises glass fibers.

10. A shutter assembly as set forth in claim 9 wherein said glass fibers are further defined as continuous filament glass fibers.

11. A shutter assembly as set forth in claim 1 wherein said fiber composition comprises polyester fibers.

12. A shutter assembly as set forth in claim 11 further comprising a solvent cement disposed between said support panel and said decorative panel for bonding said polyester fibers to said inner surface of said decorative panel through interaction with said second thermoplastic resin composition.

13. A shutter assembly as set forth in claim 12 wherein said solvent cement comprises at least one of methyl ethyl ketone, tetrahydrofuran, acetone, and cyclohexanone.

14. A shutter assembly as set forth in claim 11 wherein said fiber composition further comprises glass fibers.

15. A shutter assembly as set forth in claim 14 wherein said glass fibers are further defined as continuous filament glass fibers.

16. A shutter assembly as set forth in claim 1 wherein said fiber composition comprises aromatic polyamide fibers.

17. A shutter assembly as set forth in claim 16 further comprising a solvent cement disposed between said support panel and said decorative panel for bonding said aromatic polyamide fibers to said inner surface of said decorative panel through interaction with said second thermoplastic resin composition.

18. A shutter assembly as set forth in claim 17 wherein said solvent cement comprises at least one of methyl ethyl ketone, tetrahydrofuran, acetone, and cyclohexanone.

19. A shutter assembly as set forth in claim 16 wherein said aromatic polyamide fibers are formed from poly-paraphenylene terephthalamide.

20. A shutter assembly as set forth in claim 1 wherein said first thermoplastic resin composition comprises polyvinyl chloride.

21. A shutter assembly as set forth in claim 20 wherein said second thermoplastic resin composition comprises polyvinyl chloride.

22. A shutter assembly as set forth in claim 21 further comprising a solvent cement disposed between said support panel and said decorative panel for bonding said first surface of said support panel to said inner surface of said decorative panel through interaction with said polyvinyl chloride in said decorative panel and said support panel.

23. A shutter assembly as set forth in claim 22 wherein said solvent cement melt bonds said first surface of said support panel to said inner surface of said decorative panel.

24. A shutter assembly as set forth in claim 22 wherein said solvent cement comprises at least one of methyl ethyl ketone, tetrahydrofuran, acetone, and cyclohexanone.

25. A shutter assembly as set forth in claim 22 wherein said solvent cement further comprises polyvinyl chloride.

26. A shutter assembly as set forth in claim 1 wherein said second thermoplastic resin composition is integrated into said support panel at said first surface during manufacturing of said support panel with said fiber composition.

27. A shutter assembly as set forth in claim 1 further comprising at least one stile coupled to said outer surface of said decorative panel for providing a location to mount fasteners to said shutter assembly.

28. A shutter assembly as set forth in claim 27 wherein said outer surface of said decorative panel comprises at least one groove and said stile comprises at least one flange disposed in said at least one groove for coupling said stile to said decorative panel.

29. A shutter assembly as set forth in claim 1 wherein at least one of said decorative panel and said support panel comprise a channel.

30. A shutter assembly as set forth in claim 29 further comprising a strengthening element disposed within said channel for providing supplemental strength to said shutter assembly and for providing a location to mount fasteners to said shutter assembly.

31. An impact-resistant shutter assembly comprising:

a decorative panel having an outer surface and an inner surface and comprising a first thermoplastic resin composition;

a support panel having a first surface and a second surface and comprising a fiber composition that is different from said first thermoplastic resin composition, said first surface of said support panel being bonded to said inner surface of said decorative panel such that said fiber composition in said support panel can provide impact resistance to said decorative panel to prevent fracturing of said decorative panel upon impact from debris, wherein said fiber composition comprises at least one of polypropylene fibers, polyester fibers, and aromatic polyamide fibers; and a second thermoplastic resin composition integrated into said support panel at said first surface for bonding said first surface of said support panel to said inner surface of said decorative panel.

32. A shutter assembly as set forth in claim 31 further comprising a solvent cement disposed between said support panel and said decorative panel for bonding said first surface of said support panel to said inner surface of said decorative panel through interaction with said second thermoplastic resin composition.

33. A shutter assembly as set forth in claim 31 wherein said first and second thermoplastic resin compositions comprise polyvinyl chloride.

34. A shutter assembly as set forth in claim 33 wherein said solvent cement comprises at least one of methyl ethyl ketone, tetrahydrofuran, acetone, and cyclohexanone.

35. A shutter assembly as set forth in claim 31 wherein said fiber composition further comprises glass fibers.

36. An impact-resistant shutter assembly comprising:

a decorative panel having an outer surface and an inner surface and comprising polyvinyl chloride;

a support panel having a first surface and a second surface wherein said support panel comprises a fiber composition that is incompatible with said polyvinyl chloride of said decorative panel;

polyvinyl chloride integrated into said support panel at said first surface; and a solvent cement disposed between said first surface of said support panel and said inner surface of said decorative panel for bonding said fiber composition to said inner surface of said decorative panel through interaction with said polyvinyl chloride of said support panel such that said fiber composition provides impact resistance to said decorative panel to prevent fracturing of said decorative panel upon impact from debris.

37. A shutter assembly as set forth in claim 36 wherein said solvent cement comprises at least one of methyl ethyl ketone, tetrahydrofuran, acetone, and cyclohexanone.

38. A shutter assembly as set forth in claim 36 wherein said fiber composition comprises at least one of polypropylene fibers, polyester fibers, and aromatic polyamide fibers.

39. A shutter assembly as set forth in claim 38 wherein said fiber composition further comprises glass fibers.

* * * * *